US007074091B2

(12) United States Patent
Strayer

(10) Patent No.: US 7,074,091 B2
(45) Date of Patent: Jul. 11, 2006

(54) POWER HARNESS HAVING MULTIPLE UPSTREAM USB PORTS AND FURNITURE ARTICLE HAVING HARNESS WITH USB PORTS

(75) Inventor: Mark Strayer, Lamar, MO (US)

(73) Assignee: O'Sullivan Industries Inc., Lamar, MO (US)

( * ) Notice: Subject to any disclaimer, the term of this patent is extended or adjusted under 35 U.S.C. 154(b) by 0 days.

(21) Appl. No.: 11/124,732

(22) Filed: May 9, 2005

(65) Prior Publication Data

US 2005/0202714 A1 Sep. 15, 2005

Related U.S. Application Data

(63) Continuation of application No. 10/683,765, filed on Oct. 10, 2003, now Pat. No. 6,923,684.

(51) Int. Cl.
*H01R 25/00* (2006.01)
*H01R 27/02* (2006.01)

(52) U.S. Cl. ..... 439/652; 439/131

(58) Field of Classification Search ..... 439/652, 439/653, 131

See application file for complete search history.

(56) References Cited

U.S. PATENT DOCUMENTS

| | | | | |
|---|---|---|---|---|
| 3,706,869 | A | 12/1972 | Sorenson | |
| 5,516,298 | A | 5/1996 | Smith | |
| 5,675,813 | A * | 10/1997 | Holmdahl | 713/310 |
| 5,721,934 | A | 2/1998 | Scheurich | |
| 5,775,482 | A | 7/1998 | Wolfe | |
| 5,984,731 | A | 11/1999 | Laity | |
| 6,004,157 | A | 12/1999 | Glass | |
| 6,042,426 | A | 3/2000 | Byrne | |
| 6,147,682 | A * | 11/2000 | Kim | 345/211 |
| 6,200,159 | B1 | 3/2001 | Chou | |
| 6,211,581 | B1 | 4/2001 | Farrant | |
| 6,356,793 | B1 | 3/2002 | Martin | |
| 6,363,491 | B1 * | 3/2002 | Endo | 713/310 |
| D467,874 | S | 12/2002 | Rupert | |
| 6,586,849 | B1 | 7/2003 | Tarr | |
| 6,607,408 | B1 | 8/2003 | Milan | |
| 6,635,822 | B1 | 10/2003 | Krupa | |
| 2001/0047441 | A1 | 11/2001 | Robertson | |
| 2002/0193015 | A1 | 12/2002 | Milan | |
| 2003/0102717 | A1 | 6/2003 | Tarr | |
| 2004/0147147 | A1 | 7/2004 | Griepentrog | |

* cited by examiner

*Primary Examiner*—Hae Moon Hyeon
(74) *Attorney, Agent, or Firm*—Haynes and Boone LLP; Dave R. Hofman

(57) ABSTRACT

A desk including a plurality of panels and a power harness. The plurality of panels includes at least two substantially vertical panels supporting at least one substantially horizontal panel. The plurality of panels includes at least one panel having first and second opposing sides and an aperture extending through the first and second sides, wherein the at least one of the plurality panels having the aperture is at least one of the at least one substantially horizontal panel and the at least two substantially vertical panels. The power harness is coupled to the at least one the plurality of panels having the aperture to extend through the aperture, and includes: (1) an electrical cord extending from a housing for delivering electrical power to at least one externally accessible downstream power port at least partially contained in the housing; (2) a plurality of externally accessible universal serial bus (USB) ports each at least partially contained in the housing, the plurality of USB ports including a plurality of upstream USB ports and a plurality of downstream USB ports; and (3) circuitry interconnecting associated ones of the pluralities of upstream and downstream USB ports.

18 Claims, 4 Drawing Sheets

POWER HARNESS HAVING MULTIPLE UPSTREAM USB PORTS AND FURNITURE ARTICLE HAVING HARNESS WITH USB PORTS

This application is a CONTINUATION APPLICATION based on U.S. patent application Ser. No. 10/683,765, entitled "POWER HARNESS HAVING MULTIPLE UPSTREAM USB PORTS", filed on Oct. 10, 2003 now U.S. Pat. No. 6,923,684.

BACKGROUND

A recent trend in home and office environments has been to include an increasing number of computers and computer peripherals in individual work spaces. For example, the work area of a single desk, computer table, work station or other article of furniture may include a telephone, a facsimile machine, a desktop and/or a laptop computer which may be networked to other computers, a modem, a printer, a scanner, a keyboard and mouse, a microphone and speakers, video game controllers, portable electronic devices such as digital cameras, cellular phones and personal digital assistants and simple electrical devices such as lamps, electric pencil sharpeners and calculators. Each of these devices requires an electrical power cord for operation. Many of the devices also require additional cables for communicating voice or data signals. As a result, the typical desk can include a disorganized tangle of cables interconnecting myriad devices and power and data sources.

Moreover, peripheral devices designed to operate with home and office computer systems are typically connected to the rear of the central processing unit (CPU) of a computing system. The CPU provides the appropriate interface and control for these peripheral devices through individualized connections. The entanglement of cables discussed above is thus compounded by the limited spacing at the rear of the CPU and the connectors being closely positioned to each other on the rear of the CPU. The connector locations on the rear of the CPU also do not provide for easy access and installation of the cables connected to peripheral devices. It is common for an installer to have to reach behind the CPU in order to make a desired connection, which is sometimes performed in an awkward orientation. Due to the placement, orientation and weight of the CPU, it is not always a simple matter of moving the CPU to expose the peripheral connectors. Connecting peripheral devices directly to the CPU also typically requires close proximity of the CPU to the workspace because peripheral devices come with a limited amount of interface cabling. In other words, the peripheral devices cannot be used at a large distance from the CPU.

Thus, many workstations and other home and office furniture are available with integrated power strips or other power harnesses. The integrated power strips generally include a power cord and bus for delivering power from a wall-mounted power outlet to several power receptacles to which computers and peripherals can be connected. Because peripherals employed in conjunction with a computing system often require additional voice and data signal cabling, power strips are also available that include voice and/or data receptacles in addition to power receptacles.

However, the increased utility of personal computers coupled with their decreasing costs has also given rise to the need and/or desire to employ multiple computers within a single workstation or desk. For example, in addition to a collection of peripherals typically spaced around a work area on a desk or workstation, a computing system can include a portable "laptop" computer temporarily placed on the desk and employed in parallel with a less portable "desktop" computer having the CPU stored in, on, adjacent or under the desk. Conventionally, the collection of peripherals may be in communication with the desktop computer through a collection of universal serial bus (USB) cables, although it is desirable that the collection of peripherals also be in communication with the portable laptop computer while the laptop computer is temporarily positioned on the desk. However, communicating with the peripherals via the laptop computer requires that each peripheral be disconnected from the stationary desktop computer and reconnected to the laptop computer. Such a procedure is inconvenient and, as discussed above, difficult in view of the orientation of the desktop computer relative to the desk.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
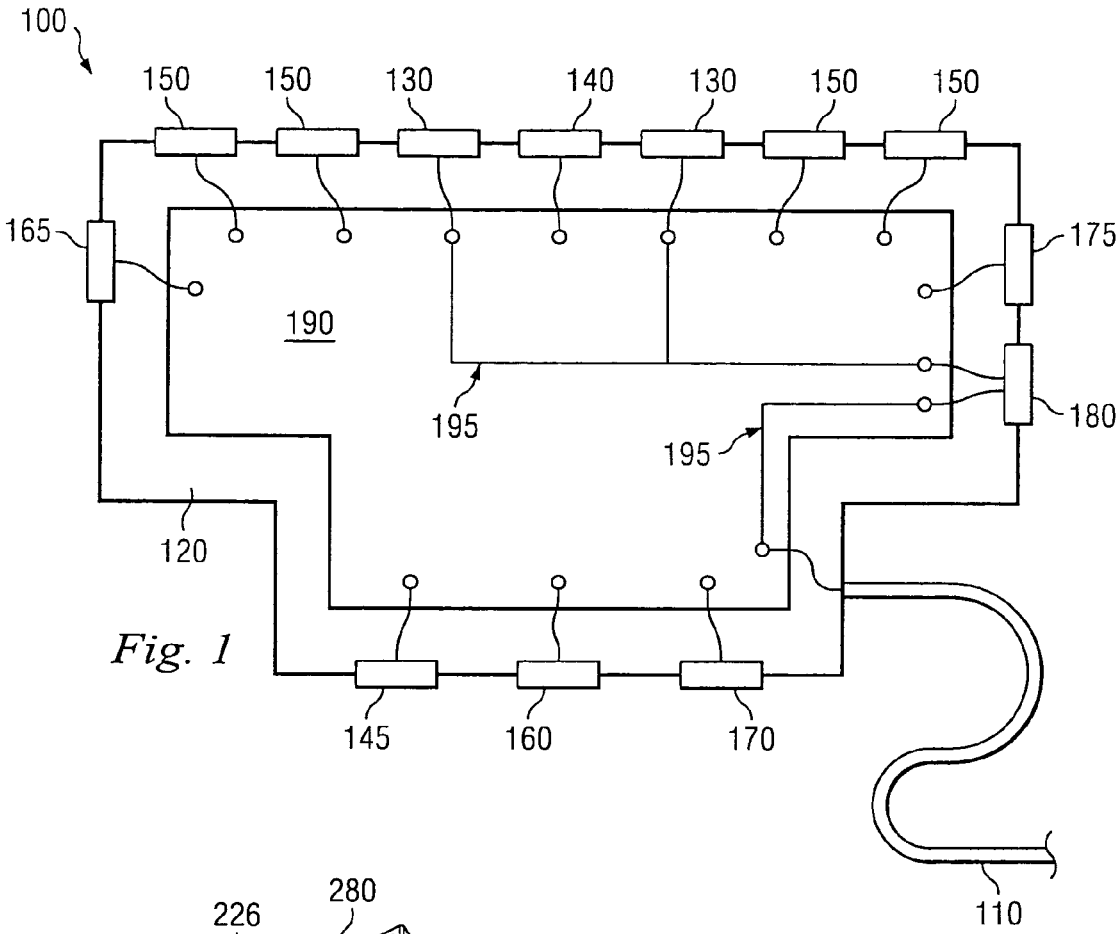
FIG. 1 is a schematic view of one embodiment of a power harness constructed according to aspects of the present disclosure.

It is to be understood that the following disclosure provides many different embodiments, or examples, for implementing different features of the invention. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. In addition, receptacles, connectors, outlets and other ports are referred to herein as "upstream"

ports if configured to be coupled to a cable or cord having an opposite terminal coupled to a desktop or laptop computer, and as "downstream" ports if configured to be coupled to a cable or cord having an opposite terminal couple to a peripheral configured to communicate with the desktop or laptop computer.

Referring to FIG. 1, illustrated is a schematic view of one embodiment of a power harness 100 constructed according to aspects of the present disclosure. The power harness 100 includes an electrical cord 110 extending from a housing 120 for delivering electrical power to at least one externally accessible downstream power port 130 at least partially contained in the housing 120. The electrical cord 110 may be a conventional two- or three-conductor cord having a sheath comprising plastic and/or another electrically insulating material. The electrical cord 110 may also include conventional stress relief, as known in the art. The electrical cord 110 may extend from the housing 120 by any desired length, although in a preferred embodiment the length may range between about 4 feet and about 8 feet. The electrical cord 110 may terminate away from the housing 120 at a conventional electrical connector, such as a NEMA 5-15P standard connector.

The housing 120 may comprise a substantially hollow shell of any shape, and may be formed by press-forming aluminum or another type of sheet metal or an electrically insulating material. In a preferred embodiment, the housing 120 is formed by injection molding a plastic material. The housing 120 may also be formed by machining a bulk material. The shape of the housing 120 may resemble a substantially spherical, cylindrical or rectangular cube shape, or a combination thereof. Moreover, as in an embodiment described below, the housing 120 may be configured to engage a panel of a desk or another article of furniture.

The downstream power port 130 may be or include a conventional two- or three-prong electrical connector configured to accept a conventional 110 volt, alternating current power connector, such as a NEMA 5-15R standard receptacle, or another conventional or future-developed power connector. However, the type of electrical connector employed in or as the downstream power port 130 is not limited by the present disclosure. The downstream power port 130 may be externally accessible through an aperture in the housing 120 exposing the downstream power port 130, and may extend outside the housing 120 or may be recessed within the housing 120. The power harness 100 may also include more than one downstream power port 130. For example, in the illustrated embodiment, the power harness 100 includes two downstream power ports 130.

The power harness 100 also includes a first upstream USB port 140, a second upstream USB port 145 and a plurality of downstream USB ports 150. The USB ports 140, 145, 150 are externally accessible and at least partially contained in the housing 120 in a manner substantially similar to the accessibility of the downstream power ports 130 discussed above. The USB ports 140, 145, 150 may be or include USB Series A or USB Series B receptacles. In the illustrated embodiment, the power harness 100 includes 4 downstream USB ports 150, although the present disclosure does not limit the number of downstream USB ports 150 included in the power harness 100. The USB ports 140, 145, 150 may also be color-coded or otherwise include features distinguishing the downstream USB ports 150 from the upstream USB ports 140, 145, and distinguishing the first upstream USB port 140 from the second upstream USB port 145. For example, the upstream USB ports 140, 145 may be labeled differently (e.g., "TO PC1" and "TO PC2") and/or may be located on opposing sides of the housing 120.

The power harness 100 may also include an upstream telephone port 160 and a downstream telephone port 165 that are externally accessible and at least partially contained in the housing 120 in a manner substantially similar to the accessibility of the downstream power ports 130 discussed above. The telephone ports 160, 165 may each be or include a 4-position modular jack (e.g., an RJ-11 receptacle), a 6-position modular jack (e.g., an RJ-12 receptacle), an 8-position modular jack (e.g., an RJ-45 receptacle) or another conventional or future-developed telephone connector. The power harness 100 may also include multiple upstream telephone ports 160 and/or downstream telephone ports 165.

The power harness 100 may also include an upstream networking port 170 and a downstream networking port 175 that are both externally accessible and at least partially contained in the housing 120 in a manner substantially similar to the accessibility of the downstream power ports 130 discussed above. The networking ports 170, 175 may each be or include an 8-position modular jack (e.g., an RJ-45 receptacle) or another conventional or future-developed network connector. The power harness 100 may also include multiple upstream networking ports 170 and/or downstream networking ports 175.

The power harness 100 may also include a power switch 180 electrically coupled between the electrical cord 110 and the downstream power port(s) 130. The power switch 180 is externally accessible and at least partially contained in the housing 120 in a manner substantially similar to the accessibility of the downstream power ports 130 discussed above. In one embodiment, the power switch 180 may be a single- or double-pole, single- or double-throw switch, including those having rocker, toggle or push-button movement. Of course, the present disclosure does not limit the type of the switch 180 that may be employed to interrupt current flow between the electrical cord 110 and the downstream power port(s) 130.

The power harness 100 also includes circuitry 190 interconnecting associated ones of the various ports described above. As such interconnections are understood by those skilled in the art, and because myriad circuits may achieve such interconnections without undue experimentation, the complete details of the circuitry 190 are not described herein. Rather, those skilled in the art will understand the circuitry 190 by the functional description of the circuitry 190 provided herein. In general, the circuitry 190 may include basic wiring and one or more circuit boards incorporating one or more integrated circuits, possibly including transformers, switches, resistors, capacitors and other active and passive electronic components, as known in the art. The circuitry 190 may also include conventional or future-developed surge protection circuitry to protect any component connected to the downstream ports 130, 150, 165, 175, etc.

The circuitry 190 connects the electrical cord 110 to the downstream power port(s) 130, possibly through the power switch 180, as schematically depicted in FIG. 1 by connecting lines 195. The circuitry may also connect the upstream telephone port 160 to the downstream telephone port 165 and the upstream networking port 170 to the downstream networking port 175. The circuitry 190 also connects the upstream and downstream USB ports 140, 145, 150 such that accessed ones of the downstream USB ports 150 communicate with an accessed one of the first and second upstream USB ports 140, 145 when only one of the first and second upstream USB ports 140, 145 is accessed, and such that accessed ones of the downstream USB ports 150 communicate with a predetermined one of the first and second upstream USB ports 140, 145 when the first and second upstream USB ports 140, 145 are simultaneously accessed.

For example, if the first upstream USB port 140 is accessed, such as by a USB cable extending to a laptop computer, but the second upstream USB port 145 remains open, the downstream USB ports 150 communicate with the first upstream USB port 140. If the second upstream USB port 145 is accessed, such as by a USB cable extending to a desktop computer, but the first upstream USB port 140 remains open, the downstream USB ports 150 communicate with the second upstream USB port 145. However, if the first and second upstream USB ports 140, 145 are accessed simultaneously, the downstream USB ports 150 communicate with only a predetermined one of the upstream USB ports 140, 145. Thus, if the second upstream USB port 145 is accessed by a USB cable extending to a desktop computer having connections not easily accessed by a user, and the user also accesses the first upstream USB port 140 by connecting a USB cable extending to a more conveniently located and accessible laptop computer, it may be preferable that the first upstream USB port 140 be the predetermined port that communicates with the downstream USB ports 150 when the first and second upstream USB ports 140, 145 are accessed simultaneously. Thus, the user may utilize a second computer to access the peripheral components that are in communication with a first computer via the downstream USB ports 150. Moreover, the access of the peripheral components by the second computer may be accomplished without disconnecting cables from the first computer.

Figure 2:
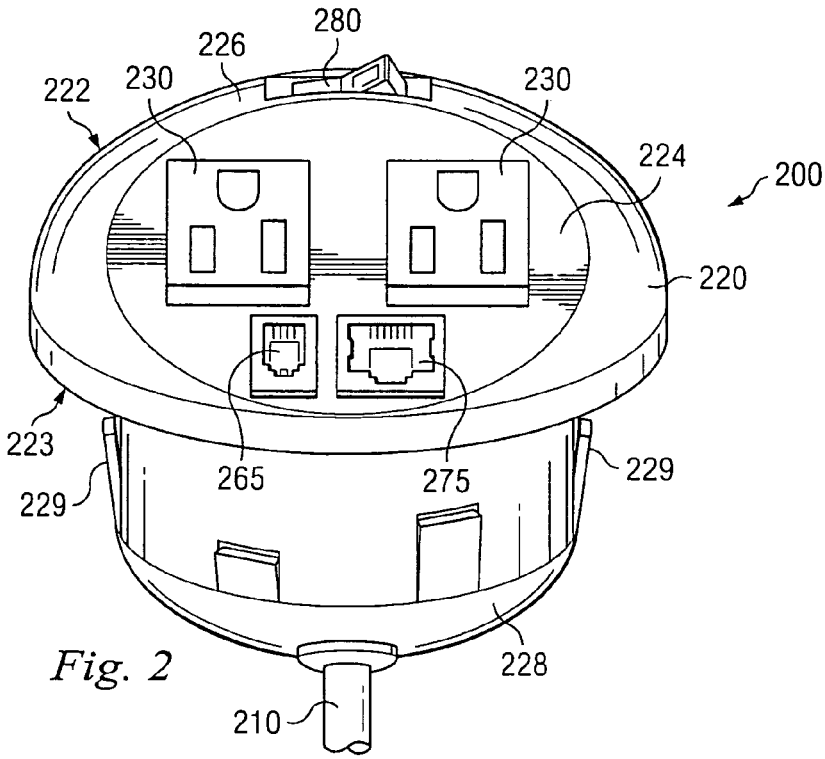
FIG. 2 is a perspective view of another embodiment of a power harness constructed according to aspects of the present disclosure.

Referring to FIG. 2, illustrated is a perspective view of another embodiment of a power harness 200 constructed according to aspects of the present disclosure. The power harness 200 may be substantially similar in composition, manufacture and function to the power harness 100 shown in FIG. 1. For example, the power harness 200 includes an electrical cord 210 extending from a housing 220 for delivering electrical power to externally accessible downstream power ports 230 at least partially contained in the housing 220. The power harness 200 also includes a downstream telephone port 265, a downstream networking port 275 and a power switch 280, each externally accessible and at least partially contained in the housing 220.

The housing 220 may include a first discrete member 222 and a second discrete member 228. In the illustrated embodiment, the first discrete member 222 forms an upper portion of the housing 220 and the second discrete member 228 forms a lower portion of the housing 220. The first discrete member 222 may also include an outer surface having a substantially planar portion 224 and a substantially spherical portion 226. The substantially planar portion 224 may at least partially contain the downstream power port(s) 230, the downstream telephone port 265 and the downstream networking port 275. The electrical cord 210 may also extend away from the second discrete member 228.

The first discrete member 222 may also include a stop 223, which may be a surface, edge or boss. The second discrete member 228 may also include one or more mechanically biasable tabs or members 229 which may cooperate with the stop 223 or other portion of the first discrete member 222 to engage a panel of an article of furniture, or an aperture therein, as described below. In one embodiment, two or more sets of biasable members 229 may be included, such that the power harness 200 may be assembled to furniture panels of varying thicknesses. For example, one set of biasable members 229 may be configured to engage a furniture panel having a thickness of about 1.0 inch, and a second set of biasable members 229 may be configured to engage a furniture panel having a thickness of about ¾". The second discrete member 228 may have a substantially cylindrical cross-sectional shape to facilitate such assembly of the power harness 200 to the article of furniture. The first and second discrete members 222, 228 may be mechanically coupled together to form the housing 220 by screws or other threaded fasteners, adhesive, a snap- or interference-fit or other fastening means.

Figure 3:
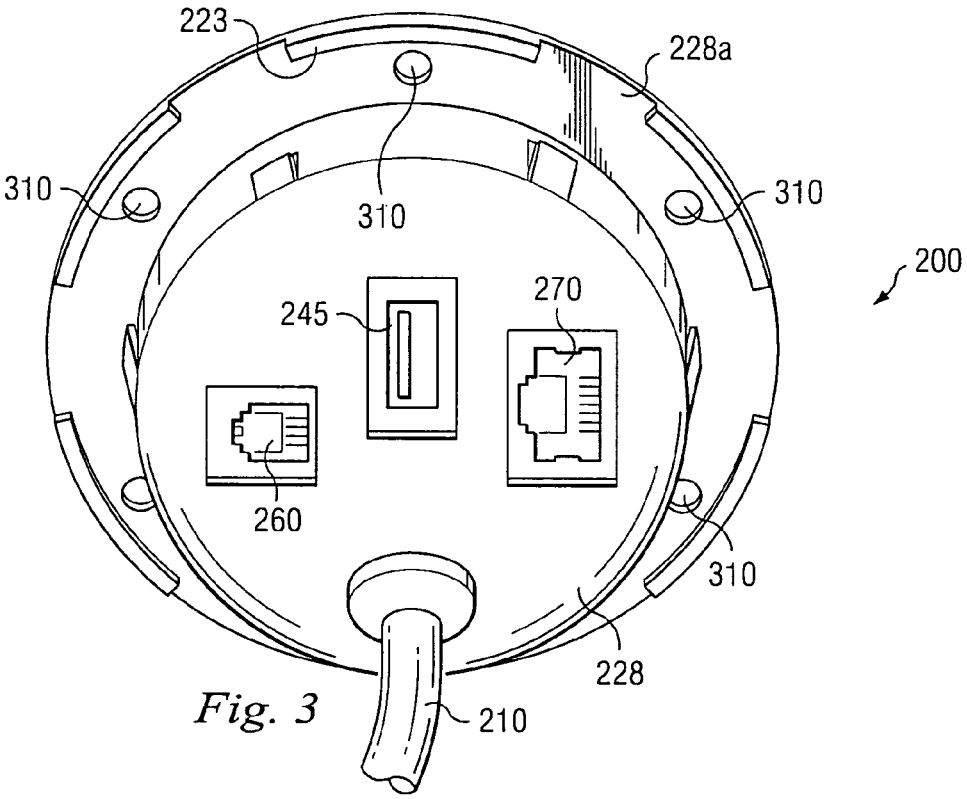
FIG. 3 is a bottom view of the power harness shown in FIG. 2

Referring to FIG. 3, illustrated is a bottom view of the power harness 200 shown in FIG. 2. The power harness 200 also includes a second upstream USB port 245, an upstream telephone port 260 and an upstream networking port 270. FIG. 3 also more clearly illustrates the electrical cord 210 extending from the second discrete member 228 of the housing 220, as well as the stop portion 223 of the first discrete member 222. FIG. 3 also illustrates that a portion 228*a* of the second discrete member 228 may cooperate with the stop 223 of the first discrete member 228 to form a stop configured to engage an edge or surface of a panel of an article of furniture. In one embodiment, the stop 223 may be entirely formed by a portion of the second discrete member 228 rather than entirely or partially by the first discrete member 222. Threaded fasteners 310 are also shown in FIG. 3 as coupling the first and second discrete members 222, 228. Of course, coupling means other than the threaded fasteners 310 may be employed within the scope of the present disclosure, including adhesives and tab/slot configurations.

Figure 4:
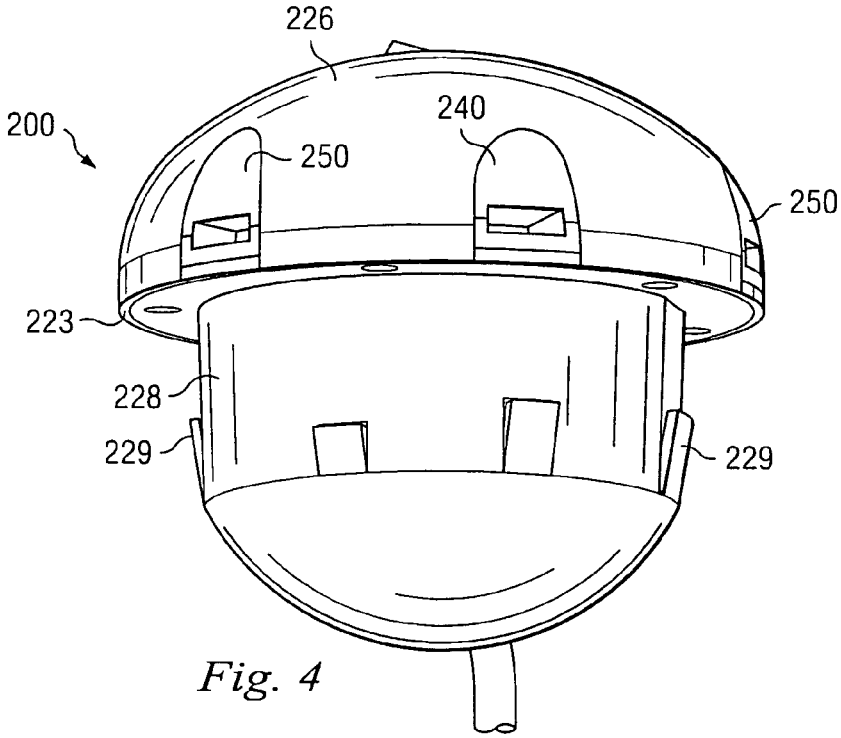
FIG. 4 is an elevation view of the power harness shown in FIGS. 2 and 3.

Referring to FIG. 4, illustrated is an elevation view of the power harness 200 shown in FIGS. 2 and 3. The power harness 200 also includes a first upstream USB port 240 and a plurality of downstream USB ports 250 that are each externally accessible and at least partially contained in the substantially spherical portion 226 of the first discrete housing member 222. In the embodiment illustrated in FIGS. 2–4, the power harness 200 includes 3 downstream USB ports 250. Of course, the number of downstream USB ports 250 is not limited by the present disclosure. FIG. 4 also more clearly illustrates the mechanically biasable members 229 of the second discrete housing member 228, as well as the stop 223 of the first discrete housing member 222.

Figure 5:
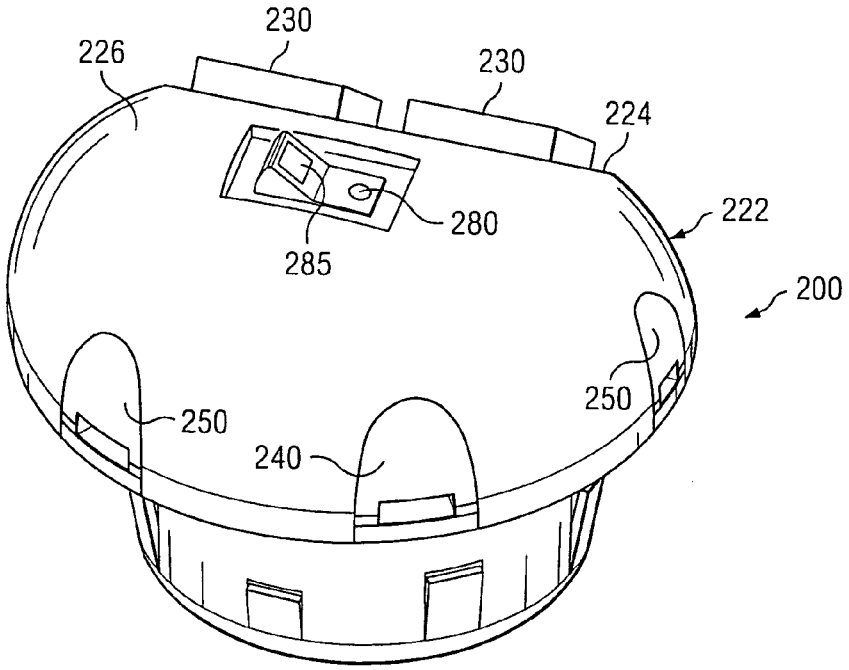
FIG. 5 is a perspective view of the power harness shown in FIGS. 2–4.

Referring to FIG. 5, illustrated is a perspective view of the power harness 200 shown in FIGS. 2–4. FIG. 5 more clearly illustrates that the first upstream USB port 240 and the downstream USB ports 250 are accessible through the substantially spherical portion 226 of the first discrete housing member 222 and that the downstream power ports 230 are accessible through or may be mounted on the substantially planar portion 224 of the first discrete housing member 222. As also shown in FIG. 5, the power switch 280 may include a light 285 or other means for indicating the status of the switch 280. For example, the light 285 may glow when the switch 280 is in an "on" position and remain inactive when the switch 280 is in an "off" position.

In FIGS. 2–5, the electrical cord 210, the housing 220, the downstream power ports 230, the USB ports 240, 245, 250, the telephone ports 260, 265, the networking ports 270, 275 and the power switch 280 may be similar in composition, manufacture, interconnection and function to the electrical cord 110, the housing 120, the downstream power ports 130, the USB ports 140, 145, 150, the telephone ports 160, 165, the networking ports 170, 175 and the power switch 180, respectively, shown in FIG. 1. Moreover, the power harness 200 includes interconnecting circuitry within the housing 220 that may be similar in composition, manufacture and function to the circuitry 190 shown in FIG. 1.

Figure 6:
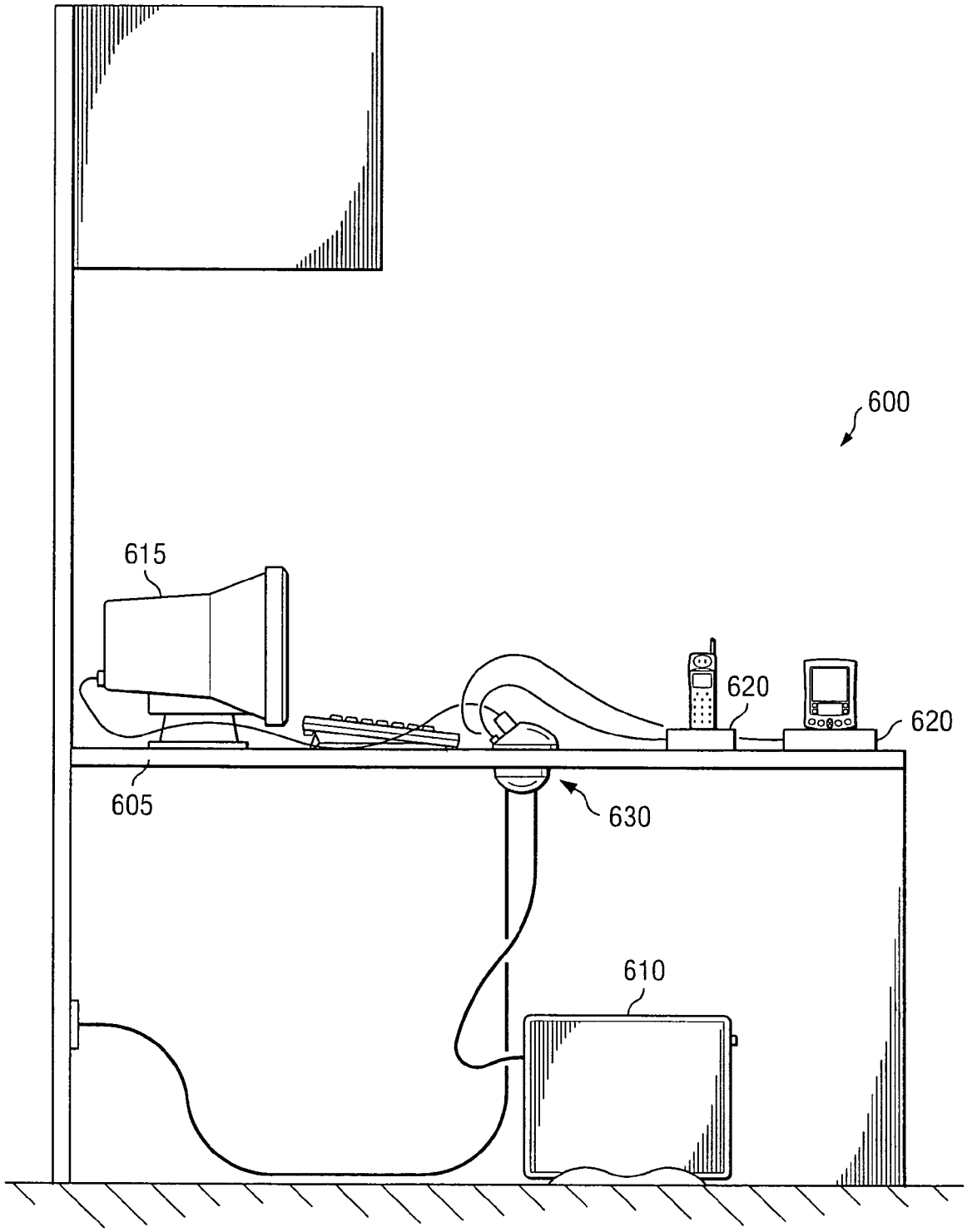
FIG. 6 is a sectional view of one embodiment of an article of furniture constructed according to aspects of the present disclosure.

Referring to FIG. 6, illustrated is a sectional view of one embodiment of an article of furniture 600 constructed according to aspects of the present disclosure. The article of furniture 600 is one environment in which the power harness 100 of FIG. 1 and/or the power harness 200 of FIG. 2 may be implemented. The article of furniture 600 may be a desk, workstation or other article at which a user may utilize a computing system 610 and one or more other electronic devices 620. In the illustrated embodiment, the article of furniture 600 is a desk, such as may be typically found in an office or home office environment, the computing system 610 is a desktop computer located under the desk 600 and having a monitor 615 located on the desk 600, and the electronic devices 620 include a cordless telephone and a personal digital assistant.

The article of furniture 600 also includes a power harness 630 coupled to a panel 605 of the furniture 600. The power harness 630 may be substantially similar in composition, manufacture and function to the power harness 100 of FIG. 1 and/or the power harness 200 of FIG. 2. The panel 605 includes an aperture configured to receive the power harness 630. Power and data cables 640 are also shown extending between the power harness 630 and the monitor 615 and electronic devices 620 over the panel 605, as well as power and data cables 645 extending between the power harness 630 and the computing system 610 and a wall-mounted power outlet 650 beneath the panel 605.

Figure 7:
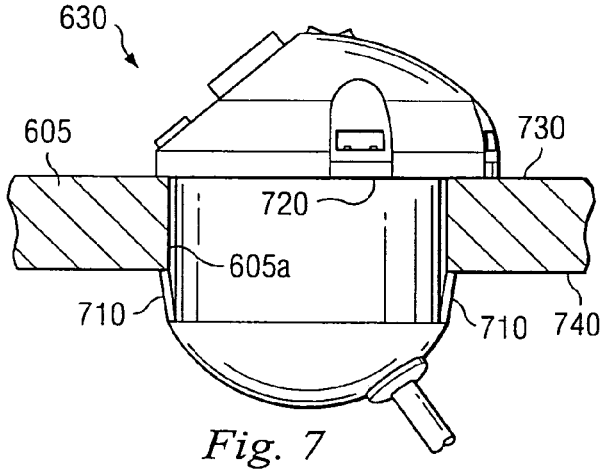
FIG. 7 is a sectional view of a portion of the article of furniture shown in FIG. 6.

Referring to FIG. 7, illustrated is a sectional view of a portion of the article of furniture 600 shown in FIG. 6 at an increased scale (the cables 640, 645 have also been removed for clarity). FIG. 7 more clearly illustrates that the power harness 630 may include mechanically biasable members 710 and a stop 720 that cooperate to engage the panel 605 through an aperture 605*a* in the panel 605. The biasable members 710 may be flexible members extending from the power harness 630 at an angle ranging between about 1 degree and about 60 degrees. The biasable members 710 may be formed integral to an exterior surface of the power harness 630, or they may be discrete members that are coupled to the power harness 630, possibly via hinges. The power harness 630 may also include torsion or compression springs to bias the biasable members 710 into the engaged positions shown in FIG. 7. The power harness 630 may also include recesses configured to receive the biasable members 710 when the biasable members 710 are deflected from their engaged positions.

The power harness 630 may be assembled to the panel 605 by inserting the power harness 630 into the panel aperture 605*a* such that the biasable members 710 deflect inward in response to interference with the boundary of the aperture 605*a*. Upon traveling through the aperture, the biasable members 710 will return to their engaged positions shown in FIG. 7, thereby preventing travel of the power harness 630 back through the aperture 605*a*. The stop 720 on the power harness 630 prevents the power harness 630 from traveling completely through the aperture, such that the power harness 630 may rest on the top surface of the panel 605 and be secured within the aperture 605*a*. The power harness 630 may be disassembled from the panel 605 by compressing the biasing members 710 to within a diameter (or other geometrically shaped cross-section) of the aperture 605*a* and sliding the power harness 630 back through the aperture 605*a*.

As shown in FIG. 7, the power harness 630 may extend entirely through opposing sides 730, 740 of the panel 605. However, in other embodiments, the power harness 630 may be positioned within and possibly engage a recess formed in the article of furniture 600. In such embodiments, the recess may include one or more apertures through which cabling from the power harness 630 may pass.

Figure 8:
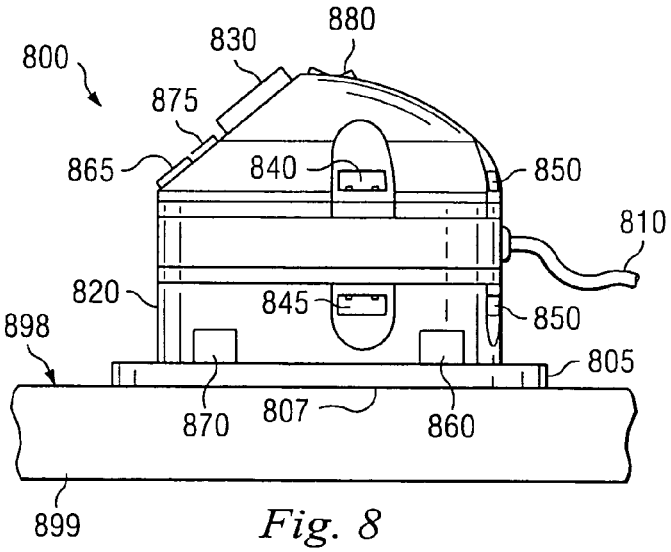
FIG. 8 is a plan view of another embodiment of a power harness constructed according to aspects of the present disclosure.

Referring to FIG. 8, illustrated is a plan view of another embodiment of a power harness 800 constructed according to aspects of the present disclosure. The power harness 800 may be similar in composition, manufacture and function to the power harness 100 of FIG. 1 and/or the power harness 200 of FIG. 2. For example, the power harness 800 includes an electrical cord 810 extending from a housing 820 for delivering power through a power switch 880 to downstream power ports 830. The power harness 800 also includes a first upstream USB port 840, a second upstream USB port 845, downstream USB ports 850, an upstream telephone port 860, a downstream telephone port 865, an upstream networking port 870 and a downstream networking port 875.

The power harness 800 also includes a base 805 having a substantially planar undersurface 807 for resting on underlying surface 898. The underlying surface 898 may be a top surface of a panel 899 or other portion of desk, computer table, article of furniture or otherwise. The power harness 800 may also include ballast substantially confined within the housing 820, preferably located between a center of gravity of the housing 820 and the undersurface 807 of the base 805. For example, the base 820 may be or comprise the ballast, such as in embodiments in which the base 820 substantially comprises a solid member of glass, marble, metal, plastic or another relatively dense material, or in embodiments in which the base 820 comprises a shell structure substantially filled with sand, water or another liquid or granular material. The ballast may enhance the stability of the power harness 800, such that the power harness 800 may be less susceptible to being inadvertently capsized or repositioned.

The present disclosure provides a power harness including an electrical cord extending from a housing for delivering electrical power to at least one externally accessible downstream power port at least partially contained in the housing. The power harness also includes a plurality of externally accessible USB ports each at least partially contained in the housing, the plurality of USB ports including first and second upstream USB ports and a plurality of downstream USB ports. The power harness also includes circuitry interconnecting associated ones of the upstream and downstream USB ports such that accessed ones of the plurality downstream USB ports communicate with: (1) an accessed one of the first and second upstream USB ports when only one of the first and second upstream USB ports is accessed; and (2) a predetermined one of the first and second upstream USB ports when both of the first and second upstream USB ports are accessed.

An article of furniture is also introduced in the present disclosure. In one embodiment, the article of furniture includes a panel having an aperture through first and second opposing sides and a power harness extending through the aperture. The power harness includes an electrical cord extending from a housing for delivering electrical power to at least one externally accessible downstream power port at least partially contained in the housing. The power harness also includes a plurality of externally accessible USB ports each at least partially contained in the housing, the plurality of USB ports including first and second upstream USB ports and a plurality of downstream USB ports. The power harness also includes circuitry interconnecting associated ones of the upstream and downstream USB ports such that accessed ones of the plurality downstream USB ports communicate with: (1) an accessed one of the first and second upstream USB ports when only one of the first and second upstream USB ports is accessed; and (2) a predetermined one of the first and second upstream USB ports when both of the first and second upstream USB ports are accessed.

The present disclosure also provides a method of manufacturing an article of furniture. In one embodiment, the method includes providing a panel having an aperture through first and second opposing sides and providing a power harness. The power harness includes an electrical cord extending from a housing for delivering electrical power to at least one externally accessible downstream power port at least partially contained in the housing. The power harness also includes a plurality of externally accessible USB ports each at least partially contained in the housing, the plurality of USB ports including first and second upstream USB ports and a plurality of downstream USB ports. The power harness also includes circuitry interconnecting associated ones of the upstream and downstream USB ports such that accessed ones of the plurality downstream USB ports communicate with: (1) an accessed one of the first and second upstream USB ports when only one of the first and second upstream USB ports is accessed; and (2) a predetermined one of the first and second upstream USB ports when both of the first and second upstream USB ports are accessed. The method of manufacturing the article of furniture also includes assembling the power harness in the aperture.

The foregoing describes features of exemplary embodiments so that those skilled in the art may better understand the scope of the present disclosure. Those skilled in the art should appreciate that they can readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure. Although embodiments of the present disclosure have been described in detail, those skilled in the art should understand that they can make various changes, substitutions and alterations herein without departing from the spirit and scope of the present disclosure.

What is claimed is:

1. A desk, comprising:

a panel; and a power harness coupled to the panel and including:

a housing;

an electrical cord extending from the housing and configured to deliver electrical power to a power port at least partially contained in the housing;

a first upstream universal serial bus (USB) port at least partially contained in the housing and externally accessible from a first spatial region;

a second upstream USB port at least partially contained in the housing and externally accessible from a second spatial region, wherein at least a portion of the panel interposes the first and second spatial regions; and an externally accessible downstream USB port at least partially contained in the housing and interconnected with the first and second upstream USB ports;

wherein the downstream USB port is configured to communicate with:

an accessed one of the first and second upstream USB ports when only one of the first and second upstream USB ports is accessed; and a predetermined one of the first and second upstream USB ports when both of the first and second upstream USB ports are accessed.

2. The desk of claim 1 wherein the downstream USB port is one of a plurality of downstream USB ports each configured to communicate with:

an accessed one of the first and second upstream USB ports when only one of the first and second upstream USB ports is accessed; and a predetermined one of the first and second upstream USB ports when both of the first and second upstream USB ports are accessed.

3. The desk of claim 1 wherein the downstream USB port is externally accessible from the first spatial region and is configured to communicate with:

an accessed one of the first and second upstream USB ports when only one of the first and second upstream USB ports is accessed; and the first upstream USB port when both of the first and second upstream USB ports are accessed.

4. The desk of claim 1 wherein the downstream USB port is one of a plurality of downstream USB ports each externally accessible from the first spatial region configured to communicate with:

an accessed one of the first and second upstream USB ports when only one of the first and second upstream USB ports is accessed; and the first upstream USB port when both of the first and second upstream USB ports are accessed.

5. The desk of claim 1 wherein the downstream USB port is externally accessible from the first spatial region and is configured to communicate with:

an accessed one of the first and second upstream USB ports when only one of the first and second upstream USB ports is accessed; and the second upstream USB port when both of the first and second upstream USB ports are accessed.

6. The desk of claim 1 wherein the panel includes opposing first and second surfaces, wherein the first surface is adjacent the first spatial region, the second surface is adjacent the second spatial region, and an aperture extends through the first and second surfaces.

7. The desk of claim 1 further comprising:

a first telephone port at least partially contained in the housing and externally accessible from the first spatial region; and a second telephone port at least partially contained in the housing and externally accessible from the second spatial region, wherein the first and second telephone ports are interconnected.

8. The desk of claim 1 further comprising:

a first networking port at least partially contained in the housing and externally accessible from the first spatial region; and a second networking port at least partially contained in the housing and externally accessible from the second spatial region, wherein the first and second networking ports are interconnected.

9. The desk of claim 1 wherein the panel is one of a plurality of panels, and wherein the power harness further comprises:

a stop;

a first mechanically biasable member configured to cooperate with the stop to engage a corresponding first thickness of a first one of the plurality of panels; and a second mechanically biasable member configured to cooperate with the stop to engage a corresponding second thickness of a second one of the plurality of panels, wherein the second thickness is substantially greater than the first thickness.

10. The desk of claim 9 wherein the first mechanically biasable member is one of a plurality of first mechanically biasable members each being substantially similar, and the second mechanically biasable member is one of a plurality of second mechanically biasable members each being substantially similar.

11. A method of manufacturing an article of furniture, comprising:

coupling a first one of a plurality of panels with a second one of the plurality of panels, at least indirectly; and coupling a power harness to one of the plurality of panels, the power harness including:

a housing;

an electrical cord extending from the housing and configured to deliver electrical power to a power port at least partially contained in the housing;

a first upstream universal serial bus (USB) port at least partially contained in the housing and externally accessible from a first spatial region;

a second upstream USB port at least partially contained in the housing and externally accessible from a second spatial region, wherein at least a portion of the panel to which the power harness is coupled interposes the first and second spatial regions; and a downstream USB port at least partially contained in the housing and interconnected with the first and second upstream USB ports;

wherein the downstream USB port is configured to communicate with:

an accessed one of the first and second upstream USB ports when only one of the first and second upstream USB ports is accessed; and a predetermined one of the first and second upstream USB ports when both of the first and second upstream USB ports are accessed.

12. The method of claim 11 wherein the downstream USB port is one of a plurality of downstream USB ports each externally accessible from the first spatial region configured to communicate with:

an accessed one of the first and second upstream USB ports when only one of the first and second upstream USB ports is accessed; and the first upstream USB port when both of the first and second upstream USB ports are accessed.

13. The method of claim 11 wherein the panel includes opposing first and second surfaces, wherein the first surface is adjacent the first spatial region, the second surface is adjacent the second spatial region, and an aperture extends through the first and second surfaces.

14. The method of claim 11 wherein the power harness further comprises:

a stop;

a first mechanically biasable member configured to cooperate with the stop to engage a corresponding first thickness of one of the plurality of panels; and a second mechanically biasable member configured to cooperate with the stop to engage a corresponding second thickness of one of the plurality of panels, wherein the second thickness is substantially greater than the first thickness.

15. A desk, comprising:

a plurality of panels including at least two substantially vertical panels supporting at least one substantially horizontal panel, wherein at least one of the at least one substantially horizontal panel and the at least two substantially vertical panels includes first and second opposing sides and an aperture extending through the first and second sides; and a power harness coupled to the at least one the plurality of panels having the aperture, the power harness extending through the aperture and including:

an electrical cord extending from a housing for delivering electrical power to at least one externally accessible downstream power port at least partially contained in the housing;

a plurality of externally accessible universal serial bus (USB) ports each at least partially contained in the housing, the plurality of USB ports including a plurality of upstream USB ports and a plurality of downstream USB ports, wherein the plurality of upstream USB ports includes a first upstream USB port and a second upstream USB port; and circuitry interconnecting associated ones of the pluralities of upstream and downstream USB ports and configured such that accessed ones of the plurality downstream USB ports communicate with:

an accessed one of the first and second upstream USB ports when only one of the first and second upstream USB ports is accessed; and a predetermined one of the first and second upstream USB ports when both of the first and second upstream USB ports are accessed.

16. The desk of claim 15 further comprising externally accessible upstream and downstream telephone ports at least partially contained in the housing, wherein the upstream and downstream telephone ports are interconnected by the circuitry.

17. The desk of claim 15 further comprising externally accessible upstream and downstream networking ports at least partially contained in the housing, wherein the upstream and downstream networking ports are interconnected.

18. The desk of claim 15 wherein the power harness further comprises:

a stop;

a first mechanically biasable member configured to cooperate with the stop to engage a corresponding first thickness of a first one of the plurality of panels; and a second mechanically biasable member configured to cooperate with the stop to engage a corresponding second thickness of a second one of the plurality of panels, wherein the second thickness is substantially greater than the first thickness;

wherein at least one of the first one of the plurality of panels and the second one of the plurality of panels is the at least one of the plurality of panels having the aperture.

* * * * *